US005794768A

United States Patent [19]

Skeffington et al.

[11] Patent Number: 5,794,768

[45] Date of Patent: Aug. 18, 1998

[54] KEY FINDER SYSTEM AND METHOD

[75] Inventors: Cheryl J. Skeffington, Mechanicsville; Kathy S. Walker, Richmond, both of Va.

[73] Assignee: Key Buddy, Inc.

[21] Appl. No.: 810,071

[22] Filed: Mar. 4, 1997

Related U.S. Application Data

[60] Provisional application No. 60/031,031, Nov. 18, 1996.

[51] Int. Cl.[6] ..... A47G 29/10

[52] U.S. Cl. ..... 206/38.1; 206/37.1; 206/813

[58] Field of Search ..... 206/37.1, 37.8, 206/38.1, 38, 37, 813

[56] References Cited

U.S. PATENT DOCUMENTS

| | | | |
|---|---|---|---|
| 3,262,479 | 7/1966 | Leguillon | 206/37.1 |
| 3,415,300 | 12/1968 | Worcester | 206/38.1 |
| 3,682,216 | 8/1972 | Nelson . | |
| 3,978,902 | 9/1976 | Adkison | 206/38.1 X |
| 4,940,250 | 7/1990 | Corrado | 206/37.1 |
| 5,069,050 | 12/1991 | Chen . | |

*Primary Examiner*—Jacob K. Ackun
*Attorney, Agent, or Firm*—Jim Zegeer, Esq.

[57] ABSTRACT

A system and method for assisting a person to rapidly find keys on a key ring in a container such as a purse, briefcase, pouch, sack, or the like comprises a fob element having a hole portion for placement on the key ring with the keys and a body portion. The body portion has at least one planar surface, a recess formed in the planar surface, first part of a two-part hook-and-loop fastener assembly is adhered to the planar surface within the recess, and the second part of the two-part hook-and-loop fastener assembly is mounted in the container at a selected location. Preferably, the softer and more comfortable-to-feel loop part of the two-part hook-and-loop fastener assembly is mounted on the fob which is carried by the user. The molded plastic member has a second planar surface that faces oppositely to the first planar surface. A logo may be emblazoned or molded in the second planar surface, and an advertising or other promotional indicia may be fitted in the second recess.

4 Claims, 2 Drawing Sheets

KEY FINDER SYSTEM AND METHOD

The present application is the subject of provisional application Ser. No. 60/031,031 filed Nov. 18, 1996 by Cheryl J. Skeffington and Kathy S. Walker, entitled KEY CHAIN.

The subject matter of the provisional application is incorporated herein by reference.

The invention is directed to the problem of finding keys in containers such as purses, briefcases, pouches, sacks, and the like. The invention enables the user to easily and quickly position keys at a known location at all times.

One is familiar with the problem of "lost" keys that are not "lost" but are merely misplaced. Frequently, the manufacturers of purses and the like articles provides a pocket or the like which usually requires a snap and are frequently not used.

The present invention provides an improved key finder system in which hook-and-loop fasteners are used in a unique and comfortable way. The invention provides a method of assisting in the rapid location of key rings and keys in a container such as a purse, briefcase, pouch, sack, gym bag or the like. According to the invention, a fob element is provided, preferably of molded plastic, having a hole portion for the placement on the key ring with the keys and a body portion having a pair of planar surfaces with recesses formed in the planar surfaces. The first recess has fitted therein one member of a hook-and-loop fastener assembly, and in the preferred embodiment, the softer, and more comfortable to touch, loop portion of the hook-and-loop assembly is secured in the recess of the key member. The recess protects the edges of the loop portion backing from delaminating during use. The reverse side of the body member and the second recess is provided to receive a logo emblazoned therein and a second logo over the first logo so as to provide advertising and promotional indicia.

The second portion of the hook-and-loop assembly, and preferably the hook portion, is mounted inside the container preferably by a strong industrial grade adhesive backing on the hook portion backing. In the preferred embodiment, the adhesive is provided with a protective peel-off plastic sheet which may be discarded. In this case, the user is able to securely fasten the hook portion of the hook-and-loop assembly at a selected location inside the container so as to provide a known location to the user for the keys. The surface of the border areas of the fob is textured on both sides, and the recesses are indented preferably one-thirty-second of an inch and measure one inch and ¼ by two inches in the preferred embodiment, thus causing a one-thirty-second inch raised border measuring one-eighth inch in width all around the edges. The one-by two-inch indented area serves specific functions on the front side of the fob, and this is used for the logo which is further recessed by another one-thirty-second of an inch for other logos which can be inserted over the first molded-in logo. The loop portion of the hook-and-loop fastener assembly is mounted on the other side of the fob.

The protective backing is peeled off by the user and attached to the inside of a container. The user then simply places the backside of the fob with the loop portion of the hook-and-loop assembly attached against the hook portion of the hook-and-loop assembly which the user has installed in the container.

Preferably, the hook portion is mounted in the container with the longest side horizontal. This provides a larger "target" to hit with the loop portion mounted on the fob. The keys are thus held in place for fast and easy access without having to fumble around to locate them. This method of attachment permits ease of retrieval as well as efficient securement and comfort to the user.

The prior art discloses the use of hook-and-loop material in connection with keys. In Chen Pat. No. 5,069,050, a pair of key rings are separably retained in assembly by complementary hook-and-loop fastening materials, one on a strap wrapped around each key ring, respectively. In Desanto Pat. No. 4,799,587, a storage case for keys is provided with plural Velcro® retainers. It is also believed that strips of adhesive Velcro® have been adhered to individual keys for purposes of hiding the keys in certain places such as cars and the like.

Thus, the object of the invention is to provide an improvement in key finder systems and methods.

According to the invention, in the preferred embodiments of the invention, the loop portion of the hook-and-loop fastener assembly is recessed in the fob so as to be protected from delamination through use and, in this preferred embodiment, the loop portion of the hook-and-loop fastener is mounted on the fob because it is softer to the touch and therefore more comfortable than the hook portion which is stiff and less comfortable. The recess on the logo side of the fob is sufficient to enable the logo to be emblazoned in the base of the recess, and the recess also serves to receive and protect from delamination advertising for advertisers who will give the assembly away to customers.

BRIEF DESCRIPTION OF THE DRAWINGS

The above and other objects, advantages and features of the invention will become more apparent when considered with the following specification and accompanying drawings wherein.

DETAILED DESCRIPTION OF THE INVENTION

Figure 1:
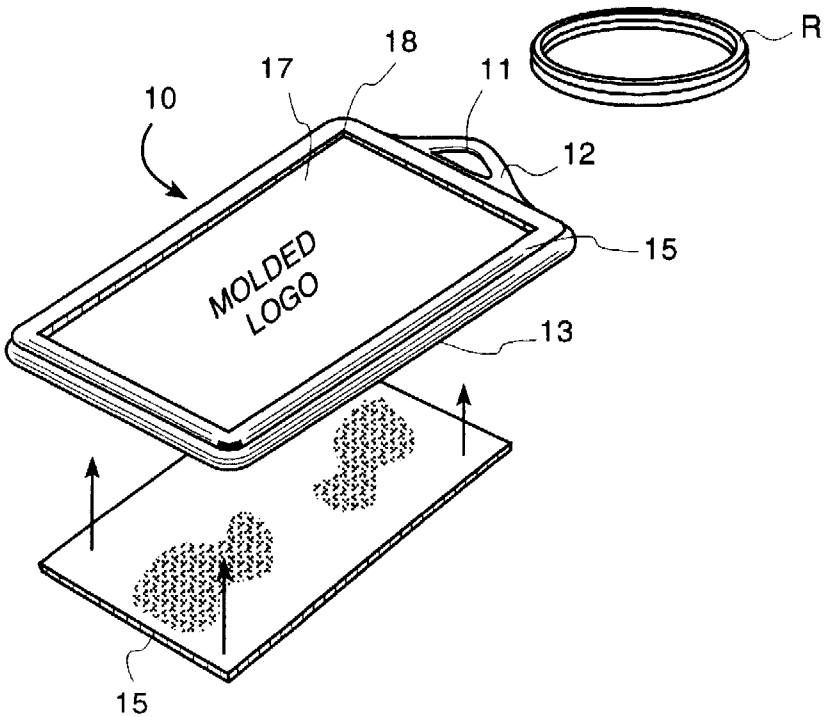
FIG. 1 is an exploded perspective view of a key ring and fob incorporated in the invention.
Figure 2:
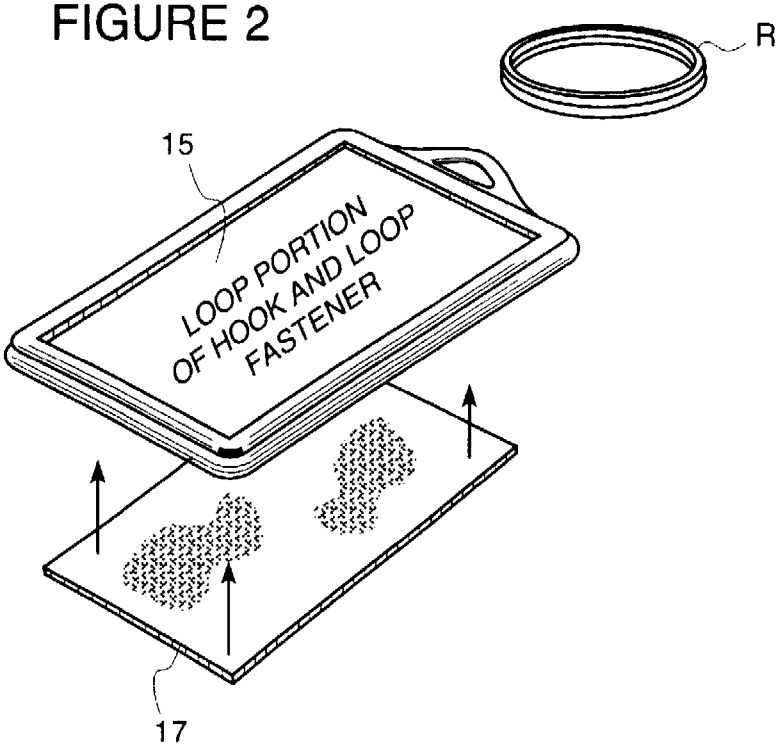
FIG. 2 is an exploded perspective view showing the reverse side of the key fob of FIG. 1.
Figure 3:
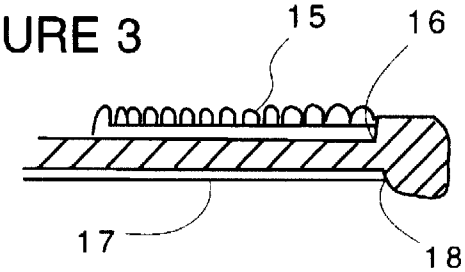
FIG. 3 is a sectional view of the key fob showing the details of a construction of the key fob shown in FIGS. 1 and 2.

Referring now to FIGS. 1, 2 and 3, a key fob 10 having a hole 11 in a key ring portion 12 and a main body portion 13.

A preferred embodiment main body 13 is molded ABS plastic but it can be molded polyurethane plastic or other plastic. The border or edge surfaces 15 are textured for appearance purposes but need not be textured. While the body member 10 is shown as rectangular, it need not be rectangular but may be circular, or configured to provide any given shape for advertising and promotional purposes. At least one of the top and bottom surfaces is planar and is adapted to receive one element of a hook-and-loop fastener such as Velcro® brand fasteners. While either the hook or the loop element of the hook-and-loop assembly can be utilized on the fob, in the preferred embodiment, one part of a hook-and-loop assembly is adhered to the planar surface in the fob 10. In the preferred embodiment, the loop part of the hook-and-loop assembly is adhered to the fob because it is softer to the feel and thus more comfortable as compared to the hook part of the hook-and-loop fastener assembly.

Referring to FIG. 1, the loop part 15 is illustrated as it is being fitted onto a planar surface on the fob member 10. As shown in FIG. 2, a recess 16 is formed in the surface of the fob 10 so as to provide protection for the hook-and-loop portion as contained therein. This protects the hook-and-loop from delamination of the adhesive that is used to adhere the hook-and-loop portion 15 in recess 16. The logo side 17 is also preferably planar and may include a molded logo or, as illustrated in FIG. 2, have a molded logo or a second logo or advertising for a promotional indicia 17 fitted into recess 18 (FIG. 3). Key ring R in this embodiment is a conventional spread metal ring upon which the keys are installed or removed in a known fashion.

Figure 5:
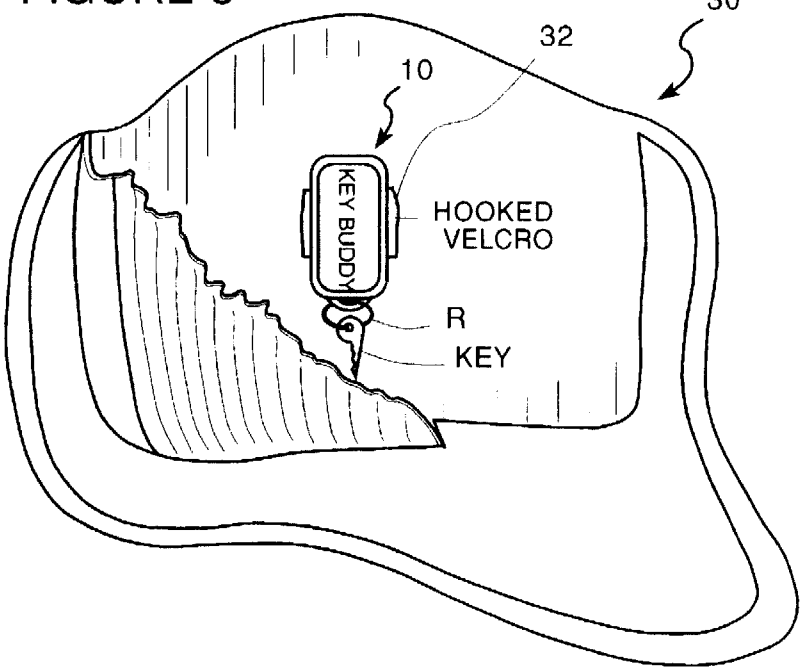
FIG. 5 is a partial sectional view of the container in FIG. 4 with a key ring detachably secured thereto.
Figure 4:
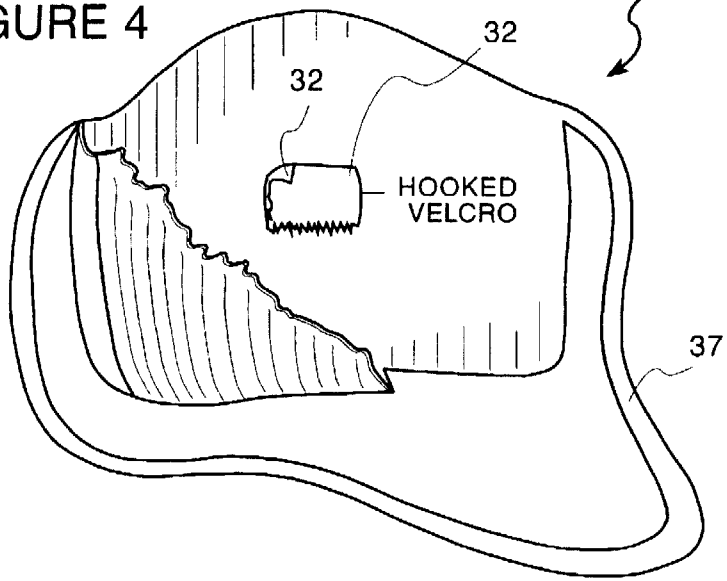
FIG. 4 is a partial sectional view of a container, such as a purse or pocketbook, with the hook portion of a hook and loop fasttener assembly.

Referring now to FIG. 4, a container 30 such as a purse, pocketbook, briefcase, pouch, sack, backpack, etc. with a carrying or shoulder strap 31 has a hook portion or part 32 of a hook-and-loop fastener assembly adhered by a commercial grade adhesive 33 (shown with a corner 33C of the hook part 32 rolled back for explanatory purposes. This is a conventional "peel and stick" arrangement. FIG. 5 shows a fob 10 with the loop portion on backside in engagement with the hook portion 32 and in a safe and easily found location in a purse. Note that the hook portion 32 in this preferred embodiment has essentially the same 1"×2" dimension of the loop part 15. In the preferred embodiment, it is mounted so that the long dimension is horizontal so that the longer area is provided to engage with the loop portion 15 on the key fob 10. It will be appreciated that one of the advantages of this arrangement is that the loop portion 15 on the fob need not be precisely aligned with the hook portion 32 on the container. In fact, only a very small percentage of the area of loop portion 15 need contact the hook portion 32 for successful mounting of the key ring R in the container 30.

While the preferred embodiments of the invention have been described and illustrated, it will be appreciated that other embodiments and adaptations of the invention will be apparent to those skilled in the art.

What is claimed is:

1. A key finder for assisting a person to rapidly find keys on a key ring in a container such as a purse, briefcase, pouch, sack, or the like comprising in combination, a rigid fob element having a hole portion for placement on said key ring with said keys and a rigid body portion, said rigid body portion having at least one planer surface, a first recess formed in said planar surface and an endless border surrounding said recess, a first part of a two-part hook-and-loop fastener assembly having edges, said first part being adhered to said at least one planar surface within said recess to keep the edges of said first part from peeling, and the borders of said recess provide a protective indentation and a smooth polished look, and a means for mounting a second part of said two-part hook-and-loop fastener assembly at a selected location in said container.

2. The key funder defined in claim 1 wherein said first part is the loop part of said two-part hook-and-loop fastener assembly.

3. A key finder for assisting a person to rapidly find keys on a key ring in a container such as a purse, briefcase, pouch, sack, or the like comprising in combination, a rigid fob element having a hole portion for placement on said key ring with said keys and a rigid body portion, said rigid body portion having at least one planar surface, a first recess formed in said planar surface and an endless border surrounding said recess, a first part of a two-part hook-and-loop fastener assembly having edges, said first part being adhered to said at least one planar surface within said recess to protect said edges and keep the edges of said first part from peeling, and said endless border of said recess provides a protective indentation and a smooth polished look, means for mounting a second part of said two-part hook-and-loop fastener assembly at a selected location in said container, wherein said fob element is a molded plastic member having a second planar surface that faces oppositely to said first planar surface and a second recess formed in said second planar surface, a logo emblazoned in said second planar surface and said second planar surface being adapted to receive an advertising logo over said emblazoned logo.

4. The key finder for assisting a person in rapidly finding a key ring with keys thereon in a container as defined in claim 3 wherein said recessed surface is sufficient to keep the edges of said hook-and-loop assembly member from peeling and the borders of said recess provide a protective indentation and a smooth polished look.

* * * * *